US005211022A

United States Patent [19]

Bartlett et al.

[11] Patent Number: 5,211,022

[45] Date of Patent: May 18, 1993

[54] CRYOPUMP WITH DIFFERENTIAL PUMPING CAPABILITY

[75] Inventors: Allen J. Bartlett, Milford, Mass.; Douglas F. Aitken, Bedford, N.H.

[73] Assignee: Helix Technology Corporation, Mansfield, Mass.

[21] Appl. No.: 702,597

[22] Filed: May 17, 1991

[51] Int. Cl.[5] ..... B01D 8/00

[52] U.S. Cl. ..... 62/55.5; 55/269; 417/901

[58] Field of Search ..... 62/55.5; 55/269; 417/901

[56] References Cited

U.S. PATENT DOCUMENTS

| | | | |
|---|---|---|---|
| 3,122,896 | 3/1964 | Hickey | 62/55.5 |
| 3,769,806 | 11/1973 | Boissin et al. | 62/55.5 |
| 4,446,702 | 5/1984 | Peterson et al. | 62/55.5 |
| 4,485,631 | 12/1984 | Winkler | 62/55.5 |
| 4,555,907 | 12/1985 | Bartlett | 62/55.5 |
| 4,724,677 | 2/1988 | Foster | 62/55.5 |
| 4,838,035 | 6/1989 | Carlson et al. | 62/55.5 |

FOREIGN PATENT DOCUMENTS 2161483 7/1973 France .

OTHER PUBLICATIONS

Haefer, "Cryogenic Vacuum Techniques," *Journal of Physics E-Scientific Instruments,* vol. 14, No. 3 Mar. 1981, pp. 273–288, Dorking (GB).

Longsworth et al., "A cryopumped leak detector," *Journal of Vacuum Science & Technology/Section A,* vol. 5, No. 4, Jul./Aug., No. 4, Part IV, pp. 2646–2649.

*Primary Examiner*—Ronald C. Capossela

*Attorney, Agent, or Firm*—Hamilton, Brook, Smith & Reynolds

[57] ABSTRACT

A cryopump is capable of pumping a process chamber at a process pressure and differentially pumping a second chamber such as an RGA independently at a substantially lower pressure. A member extends through the cryopump housing into a low pressure region disposed within the second stage array. The member comprises a port for accessing the low pressure region, thus providing an independent differential pumping source. No physical seal is required between the member and the main cryopump volume to maintain the pressure differential.

35 Claims, 3 Drawing Sheets

CRYOPUMP WITH DIFFERENTIAL PUMPING CAPABILITY

BACKGROUND

Cryopumps currently available, whether cooled by open or closed cryogenic cycles, generally follow the same design concept. A low temperature second stage array, usually operating in the range of 4° to 25° K., is the primary pumping surface. This surface is surrounded by a high temperature cylinder, usually operated in the temperature range of 70° to 130° K., which provides radiation shielding to the lower temperature array. The radiation shield generally comprises a housing which is closed except at a first stage cryopanel positioned between the primary pumping surface and the process chamber to be evacuated. This higher temperature, first stage cryopanel serves as a pumping site for higher boiling point gases such as water vapor.

In operation, high boiling point gases such as water vapor are condensed on the first stage cryopanel. Lower boiling point gases pass through and into the volume within the radiation shield and condense on the second stage array. A surface coated with an adsorbent such as charcoal or a molecular sieve operating at or below the temperature of the second stage array may also be provided in this volume to remove the very low boiling point gases. With the gases thus condensed or adsorbed onto the pumping surfaces, only a vacuum remains in the work chamber.

In systems cooled by closed cycle coolers, the cooler is typically a two stage refrigerator having a cold finger which extends through the radiation shield. The cold end of the second, coldest stage of the refrigerator is a the tip of the cold finger. The primary pumping surface, or cyropanel, is connected to a heat sink at the coldest end of the second stage of the cold finger. This cryopanel may be a simple metal plate, a cup or a cylindrical array of metal baffles arranged around and connected to the second stage heat sink. This second stage cryopanel may also support low temperature adsorbent.

The radiation shield is connected to a heat sink, or heat station at the coldest end of the first stage of the refrigerator. The shield surrounds the first stage cryopanel in such a way as to protect it from radiant heat. The first stage cryopanel which closes the radiation shield is cooled by the first stage heat sink through the shield or, as disclosed in U.S. Pat. No. 4,356,701, through thermal struts. The first stage cryopanel may compromise a chevron array or cold throttle plate. In most conventional cryopumps, the refrigerator cold finger extends through the base of the cup-like radiation shield and is concentric. In other systems, the cold finger extends through the side of the radiation shield. Such a configuration at times better fits the space available for placement of the cryopump.

In many vacuum processes, the composition of the atmosphere in the process chamber is monitored, typically with a Residual Gas Analyzer (RGA). A common application of this technique is in a sputtering system in which the process chamber operates at pressure greater than $10^{-3}$ torr. A small leak of the process atmosphere is admitted to the RGA and analyzed. Since RGA's are limited to operation at pressures of $10^{-5}$ torr, and preferably less than $10^{-6}$ torr, the RGA has to be isolated and separately pumped to a lower pressure. In such processes, a second high vacuum pump is utilized to pump the RGA to its operating pressure.

SUMMARY OF THE INVENTION

The present invention comprises a cryopump capable of pumping a process chamber at a first pressure and also capable of differentially pumping a second chamber at a second pressure which is substantially lower than the first pressure. This differential pumping capability is particularly useful in maintaining a separate chamber such as an RGA at a pressure substantially lower than the process chamber pressure without requiring a second pump.

In a preferred embodiment, a cryopump comprises a refrigerator having first and second stages. A first stage cryopanel is in thermal contact with a heat sink on the first stage and held at a temperature higher than the second stage to condense higher condensing temperature gases. The first stage cryopanel may comprise a frontal inlet orifice plate or chevron array of baffles. A second stage cryopanel is surrounded by a radiation shield and comprises an array of baffles coupled to and in close thermal contact with a heat sink on the second stage to condense low condensing temperature gases.

In accordance with the present invention, a member extends through the radiation shield into a region surrounded by the second stage array. The region has a location wherein gases must undergo multiple strikes with the array to reach the region. Since most gases are trapped after three strikes, the pressure in the region is substantially lower than the pressure external to the second stage array. Typically, the pressure in the region is two to six orders of magnitude lower than the pressure in the process chamber. The member comprises a port for accessing the substantially lower pressure region, thus serving as a conduit and providing a differential pumping source capable of achieving pressure lower than the pressure external to the second stage array. This port may be at ambient temperature and is thus spaced from the second stage array though positioned within the array.

In another preferred embodiment, the above-described cryopump is coupled to a process chamber. An RGA is also coupled to the process chamber to monitor the composition of the process atmosphere. In accordance with the present invention, the RGA is coupled to the member for accessing the low pressure region within the second stage array. The member provides a source of differential pumping to the RGA for operation at the low pressure. As such, a single cryopump pumps the process chamber at a process pressure and provides differential pumping to an RGA at a substantially lower pressure.

The invention has particular utility to side entry cryopumps since it takes advantage of a previously unused opening in the second stage array to access the low pressure region. Thus, with a side entry cryopump the integrity of the array need not be impaired in accessing the low pressure region. As such, the member extends through the opening in the array, being substantially perpendicular to the array.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed on illustrating the principles of the invention.

DETAILED DESCRIPTION OF THE INVENTION

Figure 1:
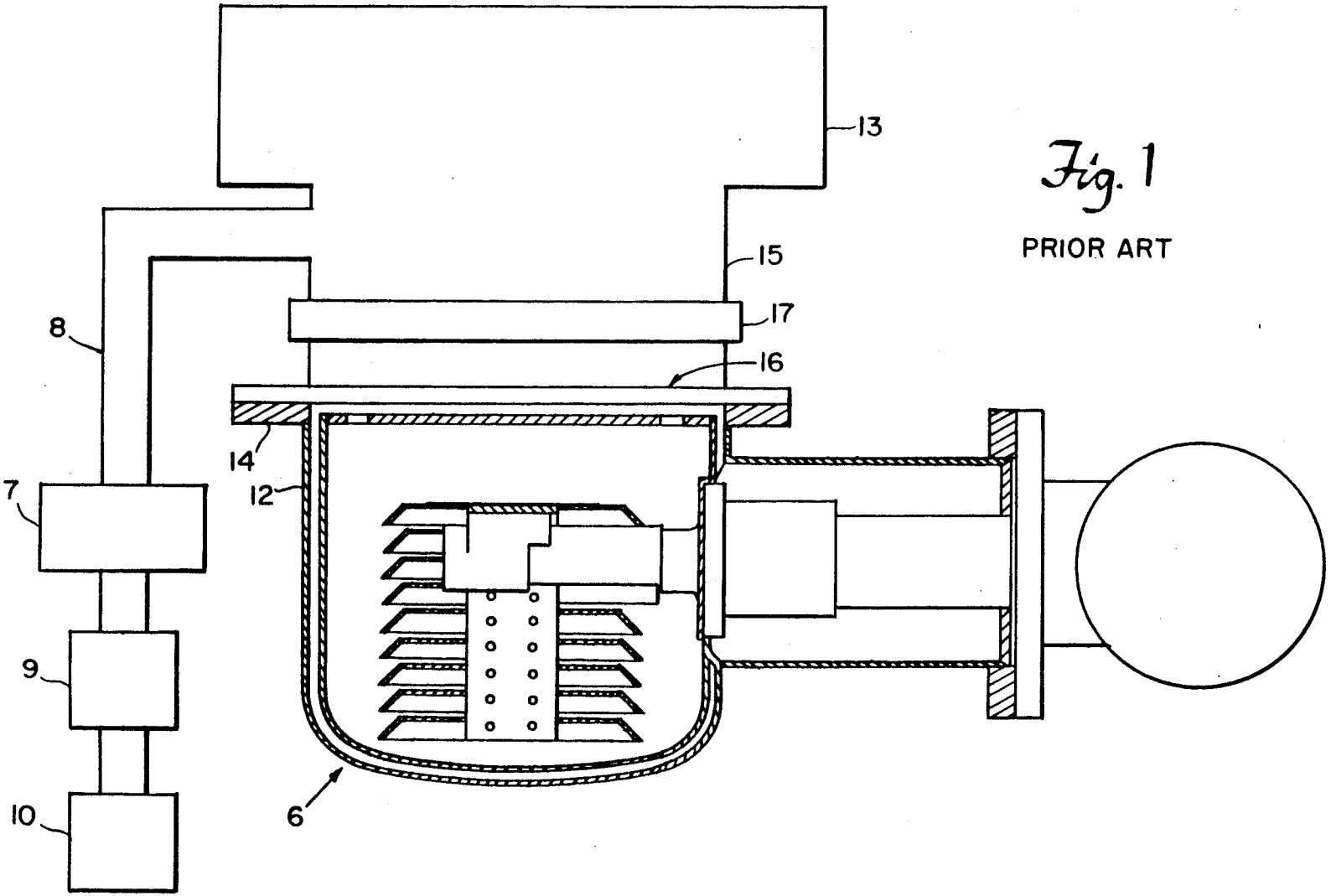
Fig. 1 PRIOR ART
FIG. 1 is a longitudinal cross-sectional view of a prior art cryopump system.

A prior art cryopump system having a Residual Gas Analyzer (RGA) 7 for monitoring the composition of the atmosphere in a process chamber 13 is shown in FIG. 1. A cryopump 6 comprises a cryopump housing 12 which may be mounted either directly to the process chamber along flange 14 or to an intermediate gate valve between it and the process conduit 15 which is connected to the process chamber 13. The conduit 15 comprises a gate valve 17 which may be employed to isolate the cryopump from the process chamber.

The RGA 7 is coupled to the process chamber by a conduit 8 for monitoring the composition of the processing atmosphere. During operation, the RGA obtains small samples (i.e. of low flow rate) of the process atmosphere via conduit 8 for analysis. The sample gas is ionized and then passed through a mass selective filter to produce an output signal corresponding to the gases present. However, RGAs are limited to operation at pressures of $10^{-5}$ torr and below. Thus, if the process operates at a pressure greater than $10^{-5}$ torr, the RGA requires a separate pumping source. A common application of this technique is in a sputtering system where the process chamber operates at a pressure greater than $10^{-3}$ torr. Typically, a second pumping mechanism is provided to support the RGA in a sputtering system. One such pumping mechanism may comprise a turbopump 9 supported by a roughing pump 10. The turbopump 9 is employed to focus gas molecules to the roughing pump 10 which exhausts the gases. Alternatively, a second cryopump has been used. Ultimately, this pumping mechanism provides the RGA with a pressure of less than $10^{-6}$ torr. That pressure is three orders of magnitude less than that of the process chamber.

Figure 2:
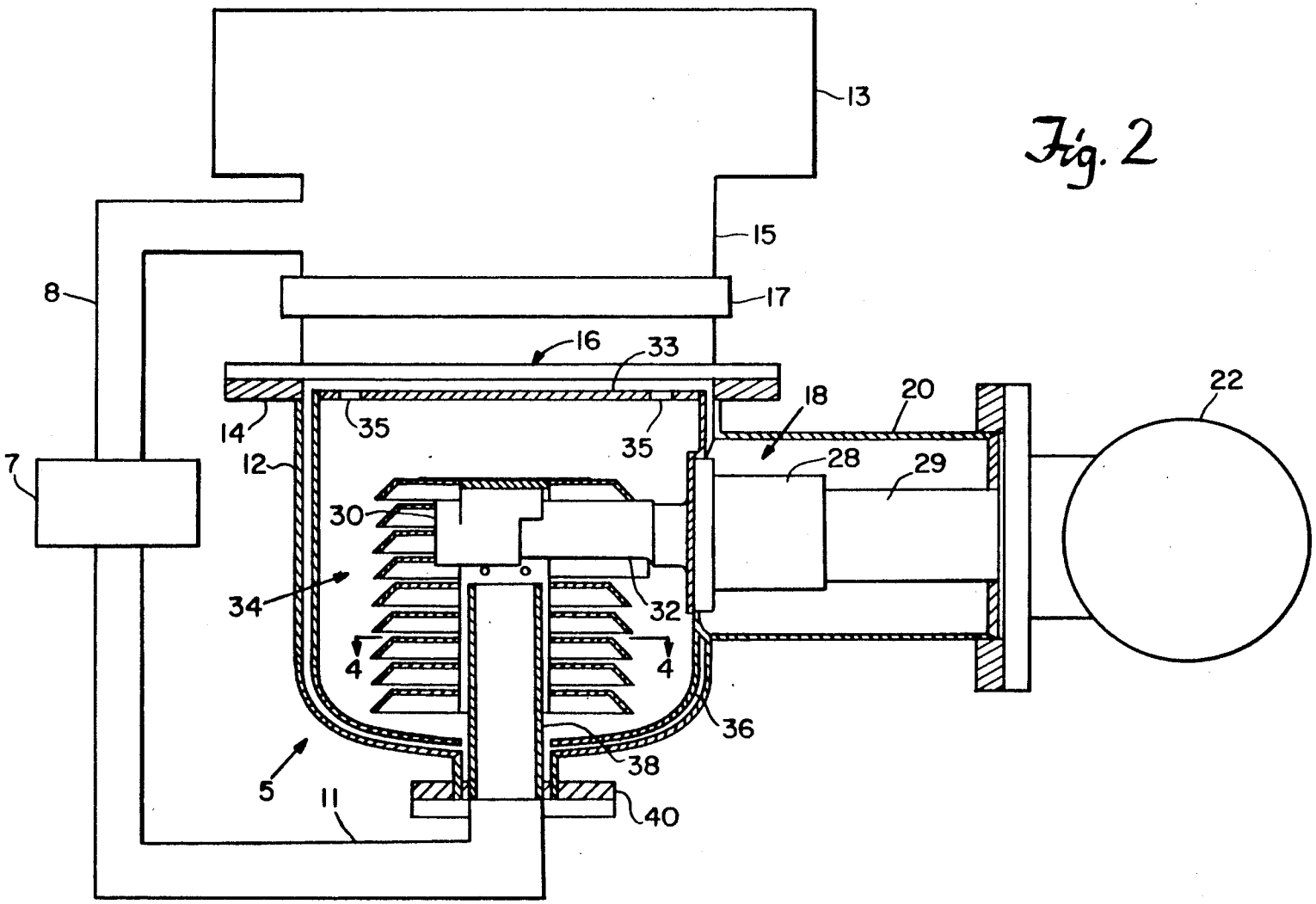
FIG. 2 is a longitudinal cross-sectional view of a cryopump system in accordance with the present invention.

Referring to FIG. 2, the present invention comprises a cryopump 5 capable of pumping the process chamber 13 at a first pressure while simultaneously being capable of differentially pumping a second chamber (i.e. RGA) at a substantially lower pressure. In a preferred embodiment, the cryopump 5 comprises a cryopump housing bolted to conduit 15 which is coupled to the process chamber 13. The front opening 16 in the vessel 12 communicates with the circular opening in the process chamber 13. A two stage cold finger 18 of a refrigerator protrudes into the vessel 12 through a cylindrical portion 20 of the vessel. The refrigerator may be a Gifford-MacMahon refrigerator as disclosed in U.S. Pat. No. 3,218,815 to Chellis et al. A two stage displacer in the cold finger 18 is driven by a motor 22. With each cycle, helium gas introduced into the cold finger under pressure is expanded and thus cooled and then exhausted through a line. A first stage heat sink or heat station 28 is mounted at the cold end of the first stage 29 of the refrigerator. Similarly, a heat sink 30 is mounted to the cold end of the second stage 32.

A primary pumping surface is an array of baffles 34 mounted to the second stage heat station 30. This array is preferably held at a temperature below 20° K. in order to condense low condensing temperature gases. A cup-shaped radiation shield 36 is joined to the first stage heat station 28. The second stage 32 of the cold finger extends through an opening in the radiation shield. This shield surrounds the second stage array 34 to the rear and sides of the array to minimize heating of the array by radiation. Preferably, the temperature of this radiation shield is less than about 130° K.

A secondary pumping surface comprises a frontal orifice plate 33 which is in thermal contact with the radiation shield 36, serving as both a radiation shield for the second stage pumping area and as a cryopumping surface for higher condensing temperature gases. The orifice plate 33 has a plurality of holes 35 which restrict flow of lower boiling point temperature gases to the second stage array.

The orifice plate acts in a selective manner because it is held at a temperature approaching that of the first stage heat sink (between 77° K. and 130° K.). While the higher condensing temperature gases freeze on the baffle plate itself, the orifices 35 restrict passage of these lower condensing temperature gases to the second stage. By restricting flow to the inner second stage pumping area, a percentage of inert gases are allowed to remain in the working space to provide a moderate pressure (typically $10^{-3}$ torr or greater) of inert gas for optimal sputtering. To summarize, of the gases arriving at the cryopump port 16, higher condensing temperature gases are removed from the environment while the flow of lower temperature gases to the second stage pumping surface is restricted. The flow restriction results in higher pressure in the working chamber.

Figure 3:
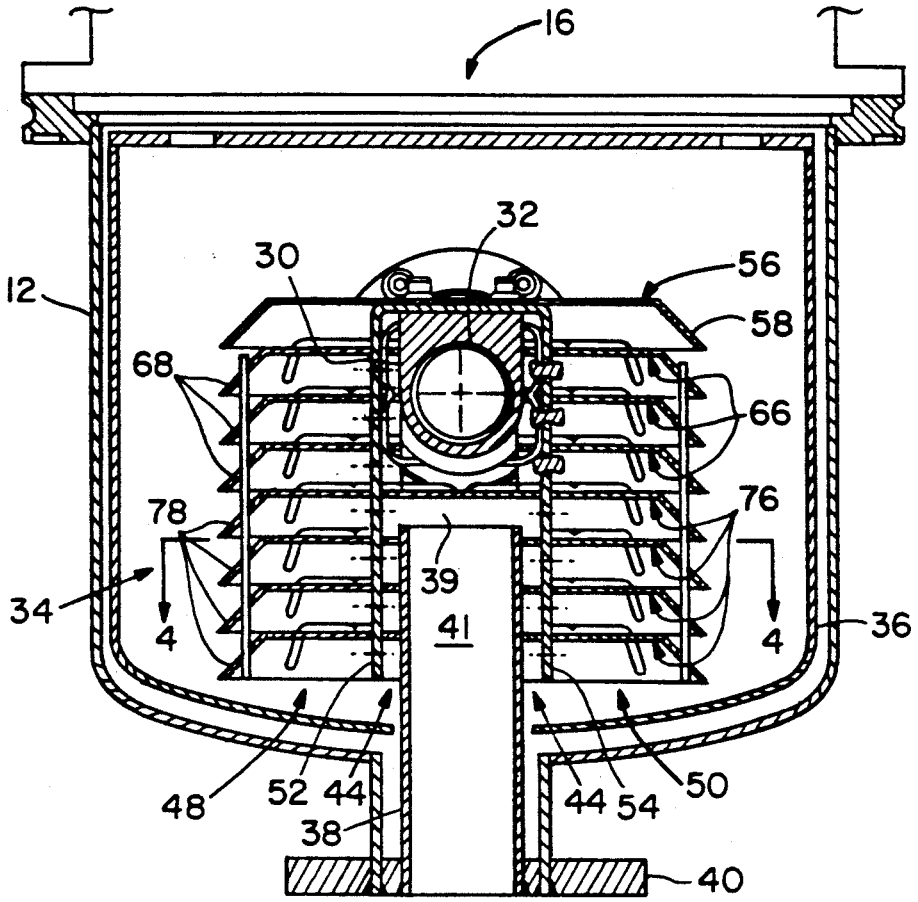
FIG. 3 is a longitudinal sectional view of the second stage array incorporating the present invention taken along a plane perpendicular to the view of FIG. 2
Figure 4:
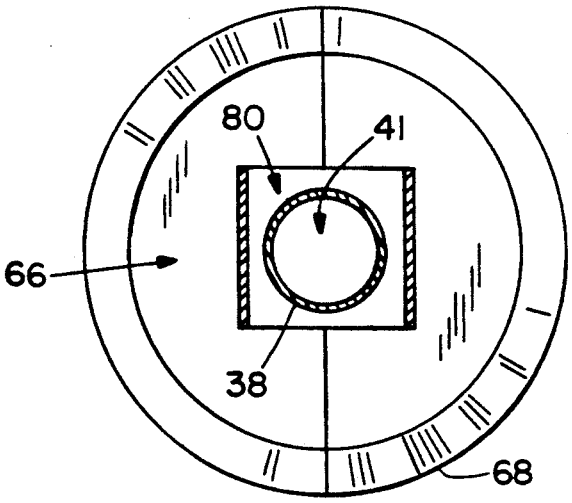
FIG. 4 is a sectional view of the second stage array of FIG. 2 taken along line 4—4.

As best shown in FIG. 3, the second stage array 34 is formed of two separate groups of semi-circular baffles 48 and 50 mounted to respective brackets 52 and 54 which are in turn mounted to the heat station 30. The brackets are flat L-shaped bars extending transverse to the cold finger 32 on opposite sides of the heat station 30. The array includes three different types of baffles similar to those disclosed in U.S. Pat. No. 4,555,907 to Bartlett. A top baffle 56 is a full circular disk having a frustoconical rim 58. The baffle 56 bridges the two brackets 52 and 54 and is joined to the heat station 30. The remaining two types of baffles 66 and 76 are semi-circular and also have frustoconical rims 68 and 78 respectively. Pairs of baffle 76 form full circular discs; whereas, baffles 66 are cutaway to provide clearance for the second stage cold finger 32.

Charcoal adsorbent, a solid at room temperature, maybe epoxied to the top, flat surfaces of the baffles 66 and 80. If a greater amount of adsorbent is required, adsorbent can also be epoxied to the lower surfaces of both the flat regions and the frustoconical rims. The frustoconical rims intercept and condense condensable gases. This prevents the adsorbent from becoming saturated prematurely. The many baffles provide large surface areas for both condensing and adsorbing gases. The brackets 52 and 54 provide high conductance thermal paths from the baffles to the heat station 30. Preferably, the baffles, brackets and heat station are formed of nickel-plated copper.

The baffles remove gases from the process chamber by trapping and immobilizing them on cryogenically cooled surfaces. As gas molecules strike the array surfaces, they are cooled and frozen to those surfaces. A typical single strike capture probability is 0.9 or better. Thus, three strikes onto a cold array surface removes 99.9% of the gases. A region within the array exists where all gases must undergo multiple strikes to reach the region. As such the pressure within the region is substantially lower than the pressure external to the array which is in turn substantially lower than that in the process chamber due to the orifice plate 33. Experiments have shown that the pressure within that region is two to six orders of magnitude less than the pressure in the process chamber.

In accordance with the present invention, a cylindrical member 38 extends into the array 34 to access the lower pressure region. More specifically, the member 38 extends through the radiation shield 36 into low pressure region 39 located within the array between the brackets 52 and 54. A flange 40 provides a seal between the member 38 and the cryopump housing 12. However, no physical seal exists in the region 44 to isolate the low pressure region 39 from the higher pressure region external to the array. Gas molecules entering the region 44 will either deflect away from the warm member 38 and become trapped on a cold surface of the array or become trapped on one of the brackets 52 or 54. As such, no physical seal is required in the region 44.

Rather, a cryoseal maintains the pressure differential of at least two orders of magnitude and as much as six orders of magnitude. The member 38 extends through opening 80 in the array of baffles in a direction substantially perpendicular to the baffles. At the distal end of the member, a port 41 is provided for accessing the low pressure region 39, thus providing a differential pumping source capable of achieving pressures substantially lower than the process pressure or the pressure external to the array.

Returning to FIG. 2, the RGA 7 is coupled to the process chamber 8 for monitoring the composition of the processing atmosphere and is further coupled to the member 38 via conduit 11 for access to the low pressure region 39. The member provides differential pumping to the RGA for operation at the low pressure which is typically two to six orders of magnitude less than the process chamber pressure. As such, the cryopump 5 is capable of pumping the process chamber at a process pressure and independently pumping the RGA at a substantially lower pressure.

The differential pumping from an internal region within the second stage array avoids the need for a separate vacuum pump dedicated to the RGA. Further, an increased signal to noise ratio is obtained relative to a turbomolecular pump due to lower partial pressure and less contamination.

While the invention has been particularly shown and described with reference to preferred embodiment thereof, it will be understood by those skilled in the art that various changes in form and details may be made without departing from the spirit and scope of the invention as defined by the appended claims. For example, although a flat pump is shown, the invention may be used with a cryopump in which the refrigerator cold finger is coaxal with the array. The advantage of the system shown is that the array configuration of the Bartlett U.S. Pat. No. 4,555,907 leaves an open volume between the brackets 52 and 54. The only modification to the cryopump is the cylinder member 38 extending through the base of the housing 12 and radiation shield 36.

The differential pumping is not limited to RGAs but has application wherever dual pressures, of high pressure difference, are required.

We claim:

1. A cryopump comprising:

a refrigerator having first and second stages;

a first stage cryopanel in thermal contact with a heat sink on the first stage and held at a temperature higher than the second stage to condense higher condensing temperature gases;

a second stage cryopanel surrounded by a radiation shield and comprising an array of baffles coupled to and in close thermal contact with a heat sink on the second stage to condense low condensing temperature gases, the baffles having surfaces with an adsorbent adhered thereon, the adsorbent being a solid at room temperature; and a member extending through the radiation shield into a region surrounded by the second stage array, the member having a port for accessing said region, there being no physical seal between said region and a region surrounding the array.

2. A cryopump as claimed in claim 1 wherein the region surrounded by the second stage array has a pressure which is at least two orders of magnitude less than a process chamber.

3. A cryopump as claimed in claim 1 wherein the first and second stages extend through a side of the radiation shield substantially parallel to the first stage cryopanel.

4. A cryopump as claimed in claim 3 wherein the member extends through an opening in the array of baffles in a direction substantially perpendicular to the array.

5. A cryopump as claimed in claim 1 wherein the baffles are semicircular disks with frustoconical rims.

6. A cryopump as claimed in claim 1 wherein the baffles are fixed to a pair brackets mounted to and in thermal contact with the second stage heat sink and extending perpendicular to the first stage cryopanel, wherein a respective array of baffle sections are fixed to and spaced along each bracket such that the baffle sections together form an array.

7. A cryopump as claimed in claim 1 wherein the first stage cryopanel comprises a frontal inlet orifice plate in thermal contact with the radiation shield so as to act as part of the radiation shield, the orifice plate restricting the flow of low condensing temperature gas to the second stage cryopanel.

8. A cryopump as claimed in claim 1 further comprising a residual gas analyzer for receiving residual gases from a volume outside of the array and coupled to the member to provide a lower pressure to the residual gas analyzer.

9. A cryopump comprising:

a refrigerator having first and second stages, a first stage cryopanel in thermal contact with a heat sink on the first stage and held at a temperature higher than the second stage to condense higher condensing temperature gases, a second stage cryopanel surrounded by a radiation shield and comprising an array of baffles coupled to and in close thermal contact with a heat sink on the second stage to condense low condensing temperature gases, the baffles having surfaces with an adsorbent adhered thereon, the adsorbent being a solid at room temperature, the refrigerator extending through a side of the radiation shield generally parallel to the first stage cryopanel; and a member extending through the radiation shield into a region surrounded by the second stage array, the member having a port for accessing said region.

10. A cryopump as claimed in claim 9 wherein the region surrounded by the second stage array has a pressure which is at least three orders of magnitude less than a process chamber.

11. A cryopump as claimed in claim 9 wherein the region surrounded by the second stage array has a pressure which is at least three orders of magnitude less than a process chamber pressure.

12. A cryopump as claimed in claim 9 wherein the member extends through an opening in the array of baffles in a direction generally perpendicular to the baffles.

13. A cryopump as claimed in claim 9 wherein the baffles are semicircular disks with frustoconical rims.

14. A cryopump as claimed in claim 9 wherein the baffles are fixed to a pair brackets mounted to and in thermal contact with the second stage heat sink and extending perpendicular to the first stage cryopanel, wherein a respective array of baffle sections are fixed to and spaced along each bracket such that the baffle sections together form a cylindrical array.

15. A cryopump as claimed in claim 9 wherein the first stage cryopanel comprises a frontal inlet orifice plate in thermal contact with the radiation shield so as to act as part of the radiation shield, the orifice plate restricting the flow of low condensing temperature gas to the second stage cryopanel.

16. A cryopump for differential pumping comprising:

a cryopump housing incorporating a pumping port for attachment to a process chamber;

a refrigerator having first and second stages, a second stage cryopanel partially surrounded by a radiation shield in thermal contact with a heat sink on the first stage, the second stage cryopanel comprising an array of baffles fixed to a pair of axially extending brackets and coupled to and in close thermal contact with a heat sink on the second stage to condense low condensing temperature gases, the baffles having surfaces with an adsorbent adhered thereon, the adsorbent being a solid at room temperature, a frontal inlet orifice plate extending across the pumping port and in thermal contact with the radiation shield so as to act as part of the radiation shield, the orifice plate being at a temperature higher than the second stage to condense higher condensing temperature gases, the refrigerator extending through a side of the radiation shield generally parallel to the orifice plate; and a member extending through the housing and radiation shield along an opening in the array of baffles in a direction substantially perpendicular to the array, the member having a part disposed in a region surrounded by the second stage array for accessing said region.

17. A cryopump as claimed in claim 16 wherein the region surrounded by the second stage array has a pressure which is at least two orders of magnitude less than a process chamber.

18. A cryopump system comprising:

a housing;

an array of baffles coupled to and in close thermal contact with a heat sink or the refrigerator;

a conduit extending through and sealed to the housing into a low pressure region within the array but without physical connection to the array;

a residual gas analyzer coupled to receive residual gases from a volume outside of the array and coupled to the conduit to provide a lower pressure to the residual gas analyzer.

19. A cryopump system comprising:

a process chamber;

a cryopump housing coupled to the process chamber and comprising a refrigerator having first and second stages;

a first stage cryopanel in thermal contact with a heat sink on the first stage and held at a temperature higher than the second stage to condense higher condensing temperature gases;

a second stage cryopanel surrounded by a radiation shield and comprising an array of baffles coupled to and in thermal contact with a heat sink on the second stage to condense low condensing temperature gases;

a member extending through the housing and radiation shield into a region surrounded by the second stage array, the region having a pressure which is lower than the pressure external to the second stage array, the member having a port for accessing the low pressure region; and a residual gas analyzer coupled to the process chamber for obtaining process atmosphere samples for compositional analysis and further coupled to the member for accessing the low pressure region to differentially pump the analyzer for operation at the low pressure.

20. A cryopump system as claimed in claim 19 wherein the low pressure region provides a pressure which is at least three orders of magnitude less than a process chamber.

21. A cryopump system as claimed in claim 19 wherein the first and second stages extend through the a side of the radiation shield substantially parallel to the first stage cryopanel.

22. A cryopump as claimed in claim 21 wherein the member extends through an opening in the array of baffles in a direction substantially perpendicular to the array.

23. A cryopump as claimed in claim 19 wherein the baffles are semicircular disks with frustoconical rims.

24. A cryopump as claimed in claim 19 wherein the baffles are fixed to a pair of brackets mounted to and in thermal contact with the second stage heat sink and extending perpendicular to the first stage cryopanel, wherein a respective array of baffle sections are fixed to and spaced along each bracket such that the baffle sections together form a cylindrical array.

25. A cryopump as claimed in claim 19 wherein the first stage cryopanel comprises a frontal inlet orifice plate in thermal contact with the radiation shield so as to act as part of the radiation shield, the orifice plate restricting the flow of low condensing temperature gas from the process chamber to the second stage cryopanel.

26. A cryopump system comprising:

a process chamber having an process pressure;

a cryopump housing coupled to the process chamber and comprising a refrigerator having first and second stages;

a first stage cryopanel in thermal contact with a heat sink on the first stage and held at a temperature higher than the second stage to condense higher condensing temperature gases;

a second stage cryopanel surrounded by a radiation shield and comprising an array of baffles coupled to and in thermal contact with a heat sink on the second stage to condense low condensing temperature gases;

wherein the refrigerator extends through a side of the radiation shield generally parallel to the first stage cryopanel; and a member extending through the housing and radiation shield into a region surrounded by the second stage array, the region having a pressure which is lower than the process pressure, the member having a port for accessing the low pressure region; and a residual gas analyzer coupled to the process chamber for periodically obtaining gas samples for compositional analysis and further coupled to the cylindrical member for accessing the low pressure region to differentially pump the analyzer for operation at the low pressure.

27. A cryopump as claimed in claim 26 wherein low pressure is at least two orders of magnitude less than the process pressure.

28. A cryopump system as claimed in claim 26 wherein the member extends through an opening in the array of baffles in a direction generally perpendicular to the array.

29. A cryopump system as claimed in claim 26 wherein the baffles are semicircular disks with frustoconical rims which are fixed to a pair brackets mounted to and in thermal contact with the second stage heat sink and extending perpendicular to the first stage cryopanel, wherein a respective array of baffle sections are fixed to and spaced along each bracket such that the baffle sections together form a cylindrical array.

30. A cryopump system as claimed in claim 26 wherein the first stage cryopanel comprises a frontal inlet orifice plate in thermal contact with the radiation shield so as to act as part of the radiation shield, the orifice plate restricting the flow of low condensing temperature gas from the process chamber to the second stage cryopanel.

31. A cryopump system for differential pumping comprising:

a process chamber having a process pressure;

a cyropump housing incorporating a pumping port for attachment to the process chamber and comprising a refrigerator having first and second stages, a second stage cryopanel partially surrounded by a radiation shield in thermal contact with a heat sink on the first stage, the second stage cryopanel comprising an array of baffles fixed to a pair of axially extending brackets and coupled to and in close thermal contact with a heat sink on the second stage to condense low condensing temperature gases, a frontal inlet orifice plate extending across the pumping port and in thermal contact with the radiation shield so as to act as part of the radiation shield, the orifice plate being at a temperature higher than the second stage to condense higher condensing temperature gases, the refrigerator extending through a side of the radiation shield generally parallel to the orifice plate; and a member extending through the housing and radiation shield along an opening in the array of baffles in a direction substantially perpendicular to the array into a region surrounded by the second stage array having a pressure which is lower than the process pressure, the member having a port for accessing the low pressure region; and a residual gas analyzer coupled to the process chamber for periodically obtaining gas samples for analysis and further coupled to the member for accessing the low pressure region to differentially pump the analyzer for operation at the low pressure.

32. A cryopump system as claimed in claim 31 wherein low pressure is at most 1/100th of the process pressure.

33. A cryopump comprising:

a housing;

an array of baffles coupled to and in close thermal contact with a heat sink or a refrigerator, the baffles having surfaces with an adsorbent thereon, the adsorbent being a solid at room temperature;

a first conduit having a first end and a second end, the first end of the first conduit sealed to the housing and extending through the housing into a low pressure region within the array but without physical connection to the array, and the second end of the first conduit being sealed and coupled to a device;

a second conduit having a first end and a second end, the first end of the second conduit sealed and coupled to said device, and the second end of the second conduit being coupled and sealed to a process chamber which is cryopumped by the array of baffles.

34. A cryopump comprising:

a housing;

an array of baffles coupled to and in close thermal contact with a heat sink or a refrigerator, the baffles having surfaces with an adsorbent adhered thereon, the adsorbent being a solid at room temperature;

a conduit extending through and sealed to the housing into a low pressure region within the array but without physical connection to the array, a residual gas analyzer for receiving residual gases from a volume outside of the array, the residual gas analyzer being coupled between a first and a second half of the conduit, the first half of the conduit connecting the residual gas analyzer to the low pressure region within the array and the second half of the conduit connecting the residual gas analyzer to the volume outside of the array providing a lower pressure to the residual gas analyzer.

35. A method of analyzing residual gas in a vacuum chamber comprising:

evacuating the vacuum chamber by means of a cryopump having a cryogenically cooled array of baffles, the baffles having surfaces with an adsorbent adhered thereon, the adsorbent being a solid at room temperature;

coupling a residual gas analyzer to the vacuum chamber and to a lower pressure region within the array of baffles such that the residual gas analyzer is differentially pumped from the lower pressure region within the baffle array; and analyzing gases passed through the residual gas analyzer from the vacuum chamber to the lower pressure region within the array of baffles.

* * * * *